US008512931B2

(12) United States Patent
Deprez et al.

(10) Patent No.: US 8,512,931 B2
(45) Date of Patent: Aug. 20, 2013

(54) DUAL COMPONENT DUAL ROLL TONER

(75) Inventors: Lode Deprez, Wachtebeke (BE); Werner Op De Beeck, Putte (BE); Karlien Torfs, Boechout (BE)

(73) Assignee: Xeikon Manufacturing N.V., Lier (BE)

( * ) Notice: Subject to any disclaimer, the term of this patent is extended or adjusted under 35 U.S.C. 154(b) by 0 days.

(21) Appl. No.: 12/949,967

(22) Filed: Nov. 19, 2010

(65) Prior Publication Data

US 2011/0064927 A1 Mar. 17, 2011

Related U.S. Application Data

(63) Continuation of application No. 12/199,011, filed on Aug. 27, 2008.

(60) Provisional application No. 60/935,688, filed on Aug. 27, 2007.

(51) Int. Cl.
*G03G 13/08* (2006.01)

(52) U.S. Cl.
USPC ..... 430/120.1; 430/120.2; 430/122.1; 430/122.7; 430/123.41; 430/123.51

(58) Field of Classification Search
USPC ..... 399/279; 430/120.1, 120.2, 122.1, 430/122.7, 123.41, 123.51
See application file for complete search history.

(56) References Cited

U.S. PATENT DOCUMENTS

| | | | | |
|---|---|---|---|---|
| 5,206,109 | A | 4/1993 | Anno | |
| 5,630,201 | A | 5/1997 | Suzuki et al. | |
| 5,923,933 | A * | 7/1999 | Anzai et al. | 399/269 |
| 5,948,582 | A | 9/1999 | Nakamura et al. | |

(Continued)

FOREIGN PATENT DOCUMENTS

| | | | |
|---|---|---|---|
| JP | 7-209910 | A | 8/1995 |
| JP | 11-24301 | | 1/1999 |
| JP | 0 962 832 | | 8/1999 |
| WO | 2007/086602 | A1 | 8/2007 |

OTHER PUBLICATIONS

European Search Report issued in EP08162956.0, dated Dec. 3, 2010, 5 pages.

(Continued)

*Primary Examiner* — Hoa V Le
(74) *Attorney, Agent, or Firm* — Bacon & Thomas, PLLC

(57) ABSTRACT

A toner comprising toner particles having at least one type of surface additive, the toner particles having an FPIA average circularity of at least 0.95, whereby at least 80% wt of the total amount of surface additives stays onto the surface of the toner particles when an ultrasonic treatment of 4500 to 4700 J/gram of toner is applied; a substrate printed or marked with the above-described toner; and a method for manufacturing a toner, said method including the steps of: mixing a binder resin, a colorant and optionally other additives, thereby forming a mixture, melting, kneading and milling said mixture, thereby obtaining a melted kneaded product, pulverizing said melted kneaded product, adding at least one surface additive before or while bringing the FPIA average circularity of said toner particles to 0.95 by modifying the shape or surface of said particles, wherein the total amount of surface additive does not exceed 2% wt of toner particles, whereby at least 80% wt of the total amount of surface additive stays on the surface of the toner particles when an ultrasonic treatment of 4500 to 4700 J/gram of toner is applied.

10 Claims, 2 Drawing Sheets

(56) References Cited

U.S. PATENT DOCUMENTS

| | | | | |
|---|---|---|---|---|
| 6,348,291 | B1 | 2/2002 | Sato | |
| 6,508,104 | B1 | 1/2003 | Deluca et al. | |
| 6,598,466 | B1 | 7/2003 | Deluca et al. | |
| 6,878,499 | B2 | 4/2005 | Proper | |
| 6,879,800 | B2 | 4/2005 | Mabuchi et al. | |
| 7,060,956 | B2 | 6/2006 | Pantigny et al. | |
| 7,090,956 | B2 * | 8/2006 | Suzuki et al. | 430/122.1 |
| 2002/0086229 | A1 | 7/2002 | Yuasa et al. | |
| 2003/0211416 | A1 | 11/2003 | Proper | |
| 2005/0175921 | A1 | 8/2005 | Morris et al. | |
| 2006/0063094 | A1 | 3/2006 | Eida | |
| 2006/0275680 | A1 | 12/2006 | Miyakawa | |
| 2008/0124635 | A1 | 5/2008 | Nakamura et al. | |
| 2009/0047592 | A1 | 2/2009 | Okamoto et al. | |
| 2010/0233607 | A1 | 9/2010 | Asano et al. | |

OTHER PUBLICATIONS

European Office Action for European Application No. 08 162 956.0-1217 dated Oct. 30, 2012 (3 pages).

* cited by examiner

DUAL COMPONENT DUAL ROLL TONER

CROSS REFERENCE TO RELATED APPLICATIONS

This application is a continuation application of U.S. patent application Ser. No. 12/199,011, filed Aug. 27, 2008, which claims the benefit of the filing date of U.S. provisional application Ser. No. 60/935,688, filed Aug. 27, 2007.

TECHNICAL FIELD OF THE INVENTION

The present invention relates to a toner system for generating high quality images in a dual roll developing unit composed of at least two magnetic rollers of which the turning direction is opposite from each other, and its use in high quality electrostatic printing or copying devices.

BACKGROUND OF THE INVENTION

In electrostatic printing and/or copying machines, a latent image is first produced on a latent image carrying means such as e.g. photoconductive surface of a photosensitive drum or other surface. A developer can be toner only or a mixture of toner and magnetic carrier particles. A developer is spread onto the latent image from a developer unit. Different imaging modes can be used such as Charged Area Development (CAD) or Discharged Area Development (DAD) as explained in "Electrophotography and Development Physics" 2nd edition 1988 by L. Schein (Springer Verlag) page 36. Using DAD, the toner is primarily attracted to those parts of the image which carry lower charge, typically as a result of imagewise discharge by an image exposure system, whereas the unexposed highly charged areas are not provided with toner. This way a toner image is created on the latent image carrying means. The toner is manipulated in the developer unit by means of the magnetic particles to place the toner into the correct state for printing or copying. Perfect control of the toner particles is required to prevent non-imagewise artifacts being generated in the image which are related to aspects of the developer and developer unit and not the image. A medium on which the copy or the print is to be made, e.g. sheet of paper or cardboard, is then brought in juxtaposition with the toner image and receives a transfer of toner. The toner is then heated to bond the toner to the medium on which the finished copy or print is formed. Possibly, several toner images are made on the latent image carrying means, e.g. using toners of different colours, prior to transferring and binding the latent image to the finished copy or print by heating.

In one type of printer or copier, the toner is spread onto the latent image carrying means using one or more magnetic brushes. The magnetic brush is created on a developing roller being part of the development unit which provides toner to the latent image carrying means.

In particular, in case two component development systems using a developer comprising a mixture of (reusable) magnetic carrier particles and non-magnetic pigmented toner or toner particles are used for making a permanent image, these developing rollers comprise an internal magnet roller or discrete internal magnet configuration of permanent magnets or electromagnets and an outer sleeve, being the developing sleeve, which can rotate with or independently of the internal magnet configuration.

The permanent magnets typically may comprise rubber bond magnets or sintered rare earth magnets or combinations thereof.

Transport of toner is typically achieved by rotating the outer sleeve while the internal magnetic core remains static but alternative configurations exist where the internal magnet configuration is rotated in addition to a rotation of the sleeve.

The magnetic carrier particles, dressed with toner particles that are attached by electrostatic forces, form bead chains in interaction with the magnetic field. The bead chains form a "brush".

Most printers of this type use developing systems with a single development roller forming a simple magnetic brush (hereinafter referred to as mono-roll development systems).

Recently the need for high speed in combination with high quality has become a requirement for how new electrophotographic devices are developed. For example, the existing Xeikon presses operate in speed ranges from 90 to 240 mm/s and are based on mono-roll development systems. Since the success of high quality digital printing, the need for higher printing speeds for some market segments is increasing, but without making any compromise with respect to image quality and print flexibility. This means that the new machines should be capable of doing at least the same what the existing engines can do, but at a higher speed.

There are several patent publications dealing with this challenge, but these originate mainly from the field of black and white printing, where completely other image quality criteria are valid.

Known development systems suitable for high speed printing comprise multiple development rollers. In some of these known systems at least one of the development rollers rotates in the opposite direction to the remaining developing rollers. In the remaining of this application, we will refer to development systems with two development rollers as dual-roll development systems.

In application U.S. Pat. No. 6,879,800 a dual roll development system of a type is described. With respect to its mechanical design, this is suitable for the apparatus, method and for use with the toner of the current invention.

In DE 19,609,104 it is pointed out that this type of development unit (having at least two opposite rotating magnetic rollers), can be used for high speed printing (600-1800 mm/s).

One of the ways to reach high development speeds with enough toner density on the substrate and low amounts of background has been described in U.S. Pat. No. 7,090,956. This application has been typically developed for black and white high speed printing (1800 mm/s). In this patent the toner used in the dual roll development system is described as "available toners which are generally used". The high speeds mentioned in that application are perfectly consistent with a binary exposing device that only creates two electrostatic potential states at the surface; one that attracts charged toner and the other that repels charged toner. In digital color printing higher screen rules and multilevel exposure increases significantly the quality of the images and therefore multi level exposure LED or laser devices are often used. This means that on a specific location on the photoconductor surface different amounts of toner can be developed depending upon the amount of light that has been sent to this specific location after charging the photoconductor drum.

The U.S. Pat. No. 7,090,956 deals with a dual roll concept that has been evaluated in the application area of "high speed and high quality full colour printing". The unit has been designed to run off line at speeds of higher than 1000 mm/s, but for doing the real high quality printing tests, the actual available hardware platform could only reach printing speeds in the range of 90-600 mm/s. Doing these tests and using general toner formulations as described in application U.S.

Pat. No. 7,090,956, we have observed a new type of image defect that was completely unknown and which has not mentioned in any previous patent application. We also did not observe anything similar when we evaluated these toner systems in the regular Xeikon printing platform which uses a developer unit with only one magnetic roller whereby the rotation goes into the same direction as the photoconductor drum. In evaluating the dual roll developing some new effect has been created with or on the photoconductor drum ending up with very uneven, non-uniform screened images. It is well known in the field of toner that additives that are not fully attached to the toner surface can generate some deposition onto the photoconductor.

In the application U.S. Pat. No. 6,878,499 is taught how to determine the amount of loose additives. It is also taught that a toner system is aimed at whereby at least 40% of the additives stay attached onto the surface under certain test conditions. When we applied this test method in a similar mode to a regular shape modified toner we found that 50% of the additives stayed onto the surface.

It is also well known in the field of electrophotographic printing that shape modified toner offers some big advantages when used in a printing process. The mobility of the toner is increased resulting in better transfer and higher image quality. There is therefore a need in the art for a shape modified toner system that brings the full advantage combination of dual roll development together with a shape modification.

SUMMARY OF THE INVENTION

The present invention relates to a toner system whose particles have a certain degree of roundness with the additives attached in a certain way in order to create high quality images in a dual roll developing unit composed of at least two magnetic rollers of which the turning direction is opposite from each other. The present invention also relates to the use of the toner in high quality electrostatic printing or copying devices.

In one aspect the present invention provides a toner comprising toner particles having at least one surface additive, the toner particles having an FPIA average circularity of at least 0.95, whereby at least 80% wt of the total amount of surface additive stays on the surface of the toner particles when an ultrasonic treatment of 4500 to 4700 J/gram of toner is applied.

The toner may be for use in a dual roll dual component development system with at least two opposite rotating magnetic rollers.

In an embodiment of the present invention, the toner may have a toner particle size distribution having a volume average particle size diameter from 5 to 10 μm.

In another embodiment of the present invention, the toner may further comprise carrier particles wherein the size of said carrier particles is from 30 to 60 micron.

In yet another embodiment of the present invention, the toner may have a development speed of at least 90 mm/s.

In a further embodiment of the present invention, the total content on surface additives comprised in or on said particles may be less than two percent per weight of toner particles.

In a further embodiment of the present invention, the toner particles may be obtainable by adding said surface additives to the toner before or while bringing the FPIA average circularity of said toner particles to 0.95 by modifying the shape or surface of said particles.

In a further embodiment of the present invention, the shape or surface modification of the toner may be done by thermo mechanical means.

In a further embodiment of the present invention, the shape or surface modification of the toner may comprise a thermal air treatment.

The toner system may be used in any electrostatic marking device such as for printing or copying.

The present invention also provides a substrate printed or marked with the above-described toner.

The present invention further provides a method for manufacturing a toner, said method comprising the ste of:

1 Mixing a binder resin, a colorant and optionally other additives, thereby forming a mixture, 1 Melting, kneading and milling said mixture, thereby obtaining a melted kneaded product, 1 Pulverizing said melted kneaded product, 1 Adding at least one surface additive before or while bringing the FPIA average circularity of said toner particles to 0.95 by modifying the shape or surface of said particles, wherein the total amount of surface additive does not exceed 2% wt of toner particles, whereby at least 80% wt of the total amount of surface additives stays on the surface of the toner particles when an ultrasonic treatment of 4500 to 4700 J/gram of toner is applied.

The present invention and its embodiments and advantages will now be described with reference to the following drawings.

DETAILED DESCRIPTION OF THE INVENTION

Figure 1:
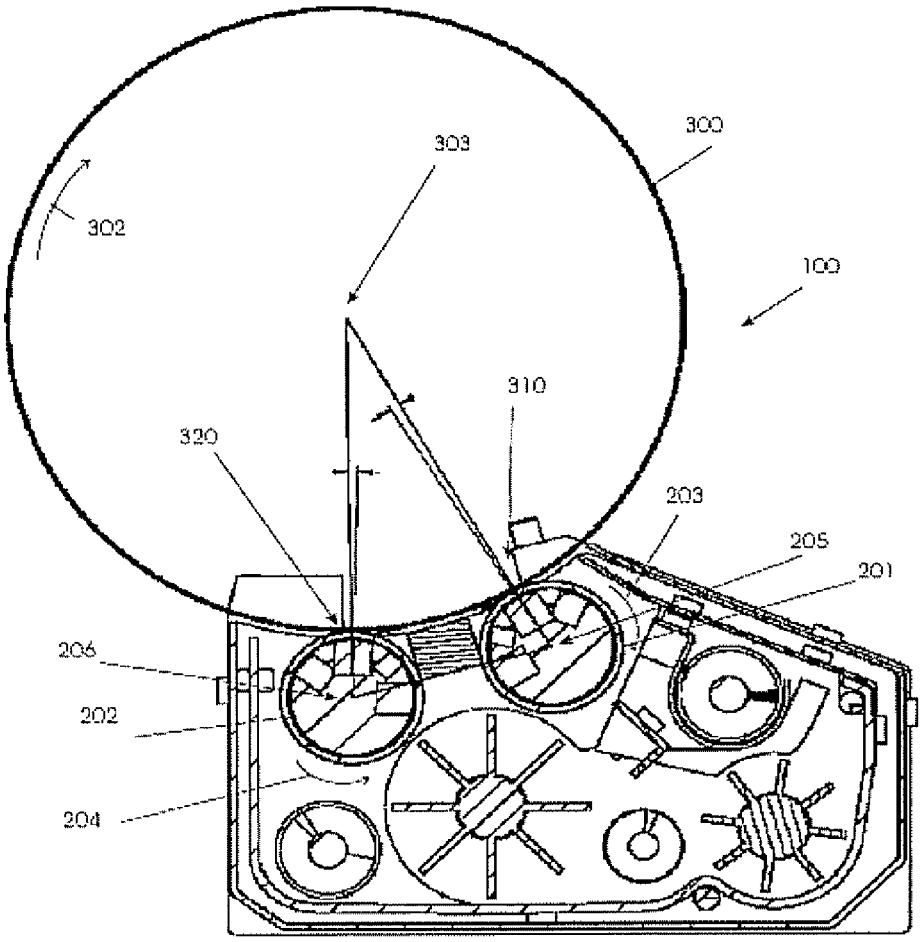
FIG. 1 shows a development unit that can be used with toner according to embodiments of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The toner of the present invention may be used in an electrostatic marking device such as printer or copier and may be applied to any suitable substrate known for use with such devices such as paper, transparent or opaque polymer substrates, cardboard, ceramics, all types of foils, etc.

In evaluating dual roll developing some new effect has been created with or on the photoconductor drum ending up with very uneven, non-uniform screened images.

Surface additives can be for example, silica, titanium oxides, organo-metallic salts, etc. A purpose of using surface additives can be to maintain the tribo-charging characteristics, transparency and flow characteristics of each toner particle, for example. Surface additives can be nanometer sized particles that adhere to the toner surface. Their improvement of the flow of toner can be by decreasing its adhesion to surfaces and they can also control the toner triboelectric charge.

In the U.S. Pat. No. 6,878,499 a test method is provided for determining the amount of loose additives. It is also taught that a toner system is aimed at whereby at least 40% of the additives stay attached onto the surface under certain test conditions. When we applied this test method in a similar mode to a regular shape modified toner we found that 50% of the additives stayed onto the surface. So it could be that some loose additives created the new phenomenon during printing. We also tested a non-shape modified toner system. This toner system didn't show this new image defect in the dual roll environment. When this toner was tested to find out how many loose additives it had applying the U.S. Pat. No. 6,878,499 like test method, we found that also 50% of the additives stayed onto the surface. This was rather strange since that shows that the amount of non-fixed additives cannot be the only cause in establishing the non-uniform screened images. On top of that we also observed an unusual speed dependence. The slower the printing process the higher the image quality decreased.

During our investigation it has surprisingly been found that if the FPIA average circularity of a toner is higher than 0.95 and if the total amount of surface additives that stay on the surface of the toner is higher than 80% when ultrasonic energy in the range of 4500-4700 J/gram of toner is applied with the ultrasonic device, then it is suited to create high quality color images in a dual component system in a multi roll development unit, e.g. whereby at least two magnetic rollers are turning in an opposite direction, and this for long times of printing.

Shape Factor Versus SF1 and SF2 (U.S. Pat. No. 5,948,582)

Until some years ago the toner shape was expressed using the parameters SF1 and SF2.

The shape coefficients SF1, SF2 of the toners are defined by the following expressions (1), (2) (see also U.S. Pat. No. 5,948,582):

$$SF1=(\text{maximum length of diameter})^2/(\text{area of toner particle})\times\pi/4\times100 \quad (1)$$

$$SF2=(\text{peripheral length of projected image})^2/(\text{area of toner particle})\times100/4\pi \quad (2)$$

Referring in detail to the above-mentioned shape coefficients, they are used as coefficients which represent the form of toners such as the shape thereof. Such shape coefficients are defined according to a statistical technique, that is, an image analysis which is able to analyze quantitatively the area, length and shape of an image caught by an optical microscope with high accuracy; and, the shape coefficients can be measured, for example, by an image analyzer and an image software. Normally (as described in U.S. Pat. No. 5,948,582 10,32-46) about 100 toner particle images are observed. Specifically, the coefficient SF1 approaches 100 as the shape of a toner particle draws near to a circle; and, on the contrary, it increases in value as the shape of the toner particle becomes long and narrow. That is, SF1 expresses a difference between the maximum and minimum diameters of the toner, namely, the distortion of the toner. On the other hand, the coefficient SF2 approaches 100 as the shape of a toner particle draws near to a circle; and, it increases in value as the peripheral shape of the toner becomes complicated. That is, the coefficient SF2 represents the uneven state property of the surface area of the toner. In the case of a complete spherical shape, SF1=SF2=100.

The above method is very time consuming and only takes a very small portion of the toner particles, so that it is very difficult to obtain a statistical relevant number of particles.

Recently, there has been a shift towards the FPIA measurement method. The following terms are provided solely to aid in the understanding of the invention.

The term "FPIA roundness" or "circularity" of a particle can be measured using a Sysmex FPIA-2100 (Flow Particle Image Analyzer) as discussed in Asia Pacific Coatings Journal (2001), 14, (1), 21-23.

The "FPIA roundness" or "average circularity" of toner particles is the average value of the "FPIA roundness" or "circularity" of a statistically representative number of particles of the toner. Depending upon the measurement time, e.g. more than 100,000 particles can be measured in a few minutes.

Figure 2:
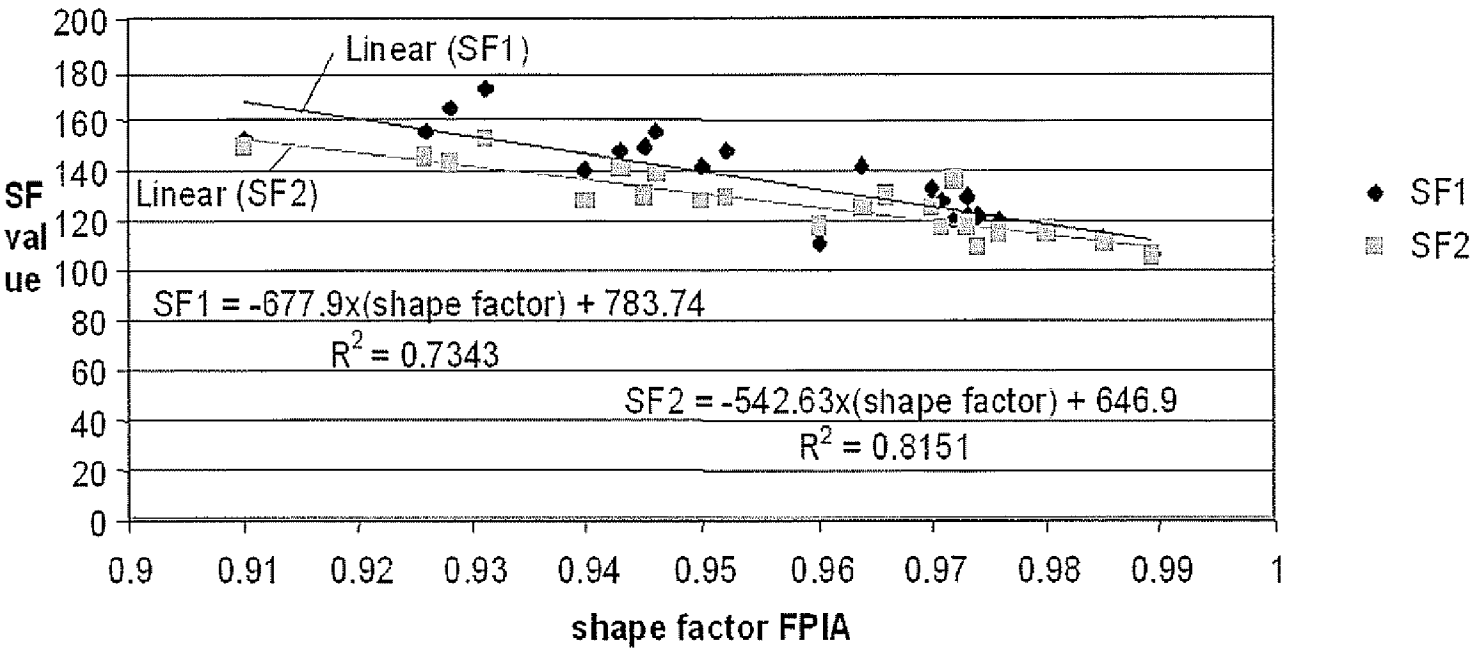
FIG. 2 shows a graph of a relationship between FPIA roundness and SF1 and SF2.

The relationship between FPIA roundness and both SF1 and SF2 have been investigated from data present in the literature (e.g. US2005/0175921 and EP0962832 where both measurement data are present) and the results are presented in FIG. 2. As shown in FIG. 2 there is a very good relationship between the two SF values and the shape factor measured by an FPIA equipment. The more round the toner shape gets, the closer SF1 and SF2 approach a value of 100 and the closer the circularity gets to a value of 1. This shows that the roundness numbers give the same value of information and from what is learnt above, it is more statistically relevant.

We can even go one step further and correlate ranges of SF1 and SF2 to ranges of shape factor values. E.g. if a toner is described with a range of SF1 between 120 and 170, and a SF2 value range between 110 and 130, then the corresponding shape factor range of this toner is between 0.935 and 0.985. For this approach we took into account an error amount of +/−10% on the measured SF values, since we know that the reproducibility is far less compared to an FPIA measurement.

To conclude this comparison we also double checked a toner formulation with both techniques. A potato shape toner particle resulted in a SF1 factor of 147 and SF2 factor of 126 and gave a FPIA shape factor of 0.970 which is also perfect in accordance with the relationship we derived from data in literature.

Measuring the Amount of Well Fixed Additives

It is well known in literature that additives on the toner surface are performing multiple functions like transportability, transfer efficiency, charging properties, fusing and gloss properties and reduction of relative humidity. The additives generally have to be on top of the surface in order to be efficient but also have to be partially embedded in order to stay there during the total life time of the toner particle when it is still in its corpuscular form. U.S. Pat. No. 6,598,466 and U.S. Pat. No. 6,508,104 describe an ultrasonic apparatus methodology for measuring the adhesion of surface additives whereby toners are suspended in a solution prior to the application of ultrasonic energy. In the measurements described, the relationship was investigated between the amount of loose additives and the obtained image density in print. The more the additives remained fixed onto the surface the less image density was obtained. The area of fixation which was investigated was between 35 and 65%. Different toners have been investigating with different levels of surface additives and different levels of surface treatment.

U.S. Pat. No. 6,878,499 teaches the impact of an additive mounting device on the adhesion of additives onto the surface. Toner particles are suspended in an aqueous solution prior to using ultrasonic energy. This energy brings the additives into solution which are not adhered well to the toner surface. Measuring the toner weight before and after this treatment gives an indication of how much of the additives was lost during the ultrasonic treatment. If one were to combine this method with XRF measurements before and after ultrasonic treatment one could also find out if one type of additive (e.g. titanium oxide) is more preferentially lost compared to another, (e.g. aluminum oxide or silicon oxide).

This method is very valuable and is very well described. If one wants to use the same method and create comparable results it is important that the amount of energy which has been used to remove the additive particles can be compared or is in the same magnitude.

In U.S. Pat. No. 6,878,499, 12 kJ is used for an amount of liquid of 40 mL (equipment VCX 750 Watt Ultrasonic Processor from Sonics and Materials Inc). This amount of energy was introduced in a period of 10-12 minutes. This brings the total amount of energy introduced per mL of liquid to 300 J/mL. We took over this amount of energy when applying the method to our ultrasonic equipment. The equipment we used was a water containing Elma Transsonic T 700 equipment where the total amount of bath liquid and dispersion liquid was 6000 mL. In order to apply the same amount of energy we used a period of 94 minutes. The HF peak in this equipment was 320 Watt (or Joule/second). Multiplying over a time period of 5640 seconds this and dividing by 6000 mL brings the total amount of energy also to the same level of 300 J/mL. When this amount of energy is calculated to the amount of toner we could calculate that approximately each gram of toner receives 4615 Joule/gram of ultrasonic energy or 12 kJ per 2.6 grams. We further constantly used this amount of energy throughout our experiments within a range of 4500 to 4700 J/gram of toner.

In application JP11024301 the same methodology is used for optimizing a mono component toner system in which the inventors claim that the amount of additives that stick to the toner surface should be in the range of 10-30% when the ultrasonic treatment is applied in order to create the optimal system in the described mono component cassette. This shows that the ultrasonic method is well accepted and that the optimal adhesion % can differ very much depending upon the specific environment which is targeted. The methodology used in this application for the mounting of the additives was also Henschel type of mixing with the following parameters; rotation speed between 20-40 meters per second and an addition time between 5-20 minutes.

Description of Developer Unit

FIG. 1 shows schematically a development unit 100 in accordance with one embodiment of the present invention. The development unit 100 comprises a first developing roller 201 and a second developing roller 202.

Various types of developing roller 201 may be used. The developing roller may include a developing sleeve. To make a sleeve for a developing roller various surface treatments are known, e.g. sand-blasting and/or anodizing. Various materials can be used such as various grades of steel including stainless steel or aluminum. The surface treatment of a developer roller is designed to provide the correct formation of the magnetic brush and to control adhesion of the toner to the surface of the roller to prevent filming.

In one embodiment of the present invention a developing roller for providing a magnetic brush comprises a developing sleeve. This sleeve provides the outer surface of the developing roller. The developing sleeve has a substantially cylindrical outer surface, the sleeve comprising a number of isolated areas at its outer surface, each isolated area being provided by a recess in the outer surface. The sleeve is intended to rotate relative to an internal magnet configuration. Each isolated area is completely surrounded by a separation zone. The separation zone comprises a part of the outer cylindrical surface of the sleeve or roller. Such a sleeve is known from the European patent application EP 07447029, entitled "Developer Roller" from the same applicant which is incorporated herein by reference in its entirety.

In an operational configuration the development unit 100 is provided in a fixed positional relation to the latent image bearing member 300, e.g. a drum or a belt. The first and second developing rollers 201 and 202 are provided to transfer toner particles from the magnetic brush to the latent image bearing member 300 at a transition points 310 and 320. As indicated with arrow 302, the latent image bearing member 300 rotates in a clockwise direction about an axis 303.

For the embodiment as shown in FIG. 1, and as indicated with arrow 203, the first developing roller 201 rotates clockwise about an axis 205. The second developing roller 202 rotates counter clockwise about an axis 206, as indicated by arrow 204. At least one of the rollers, such as the last roller rotates in a counter-clockwise direction. For this particular setup, the sequence "first", "second" and "last" is to be understood as the sequence in which the rollers are facing a given point travelling with the image carrying member that is rotating, in this particular case rotating clockwise.

At the transition point 310, the first developing roller 201 has a linear speed of Vr1 and the latent image bearing member 300 has a linear speed of Vf1. Vr1 and Vf1 are in opposed directions. At the transition point 320, the second developing roller 202 has a linear speed of Vr2 and the latent image bearing member 300 has a linear speed of Vf2. Vr2 and Vf2 are in the same direction. The magnitude of Vf1 and Vf2 can be the same. The ratio between the Vr and Vf gives a value which indicate the relative speed of the developer roller towards the photoconductor unit. When this value is 1 and the magnetic roller is rotating into same direction of the photoconductor, this means that both rollers have the same linear speed.

According to an embodiment of the present invention, there is provided a toner having toner particles each comprising a binder resin, a colorant, and optionally a releasing agent, and fine particles. The fine particles may be used as surface additives. The fine particles may be inorganic fine particles, or fine particles having an inorganic core or comprising an inorganic element such as calcium, titanium, silicium, aluminium or strontium. The binder resin may comprise a polyester unit. In accordance with an embodiment of the present invention, external additives (i.e. surface additives) including the fine particles, preferably inorganic fine particles, are externally added to the toner particles in such way and amount that the total amount of additives stay fixed onto the surface for at least 80% wt when ultrasonic energy as described above is applied. None of the toners tested in U.S. Pat. No. 6,878,499 shows an adhesion of more than 80%. The method used to obtain toner having this property is not critical. Mainly the final result counts. This ultrasonic treatment is applied with an amount of energy to one gram of toner in the range of 4500-4700 Joules. In this embodiment, the toner has also been surface treated or shape modified to obtain the desired average FPIA circularity level of at least 0.95. The method used to obtain toner having this property is not critical. Mainly the final result counts. With the above toner when used in a dual roll environment with at least two opposite rotating magnetic brush members, good image quality is obtained in combination with very uniform images in screened areas and this can be maintained over prolonged use in a high-speed machine with speeds ranging from 90 mm/s up to 1000 mm/s.

The binder resin to be used in the toner of the present invention can be optionally a resin selected from the group consisting of: (a) a polyester resin; (b) a hybrid resin comprising a polyester unit and a vinyl-based polymer unit; (c) a mixture of a hybrid resin and a vinyl-based polymer; (d) a mixture of a polyester resin and a vinyl-based polymer; (e) a mixture of a hybrid resin and a polyester resin; and (f) a mixture of a polyester resin, a hybrid resin, and a vinyl-based polymer.

A molecular weight distribution of the toner of the present invention measured by gel permeation chromatography (GPC) of a resin component can have a main peak in the molecular weight range of 3,000 to 30,000, preferably in the molecular weight range of 5,000 to 20,000.

The binder resin to be comprised in the toner of the present invention can have a glass transition temperature of preferably 40 to 90° C., more preferably 45 to 85° C. The binder resin can have an acid value of preferably 1 to 40 mgKOH/g.

This invention also applies in the case when UV curable resin systems are used in order to make toner particles that can be cured after the image formation process during or after the fusing process. The curing or crosslinking can be initiated with UV light or electron beam.

The toner of the present invention can be used in combination with a known charge control agent. Examples of such a charge control agent include organometallic complexes, metal salts, and chelate compounds such as monoazo metal complexes, acetylacetone metal complexes, hydroxycarboxylic acid metal complexes, polycarboxylic acid metal complexes, and polyol metal complexes. In addition to the above compounds, the examples thereof include: carboxylic acid derivatives such as carboxylic acid metal salts, carboxylic anhydrides, and carboxylates; and condensates of aromatic compounds. Examples of a charge control agent include phenol derivatives such as bisphenols and calixarenes. In the present invention, metal compounds of aromatic carboxylic acid is preferably used to render rising of charge satisfactory.

In the present invention, a charge control agent content is preferably 0.1 to 10 parts by mass, more preferably 0.2 to 5 parts by mass with respect to 100 parts by mass of the binder resin.

The toner system can be used in contact fusing and/or non contact fusing systems. In case contact fusing is applied, an additional releasing agent can be introduced into the toner system. Examples of the releasing agent which can be used in the present invention include: aliphatic hydrocarbon-based waxes such as a low molecular weight polyethylene wax, a low molecular weight polypropylene wax, a microcrystalline wax, a paraffin wax, and a Fischer-Tro wax; oxides of aliphatic hydrocarbon-based waxes such as a polyethylene oxide wax; waxes mainly composed of fatty esters such as an aliphatic hydrocarbon-based ester wax; and fatty ester waxes such as a deoxidized carnauba wax obtained by removing part or whole of acidic components.

A molecular weight distribution of the releasing agent can have a main peak preferably in the molecular weight range of 350 to 2,400, more preferably in the molecular weight range of 400 to 2,000 The content of the releasing agent to be used in the present invention is preferably 1 to 10 parts by mass, more preferably 2 to 8 parts by mass with respect to 100 parts by mass of the binder resin.

Known pigments, colorants or dyes may be used alone or in combination as the colorant to be used in the present invention. The usage amount of the colorant is preferably 1 to 15 parts by mass, more preferably 3 to 12 parts by mass, still more preferably 4 to 10 parts by mass with respect to 100 parts by mass of the binder resin. When special or dedicated colors are needed (e.g. green, orange, blue, red, purple, brown, . . . ) other pigments than the ones generally used for CMYK printing can be introduced. In addition, clear toners (without pigments), magnetic pigments, ceramic pigments, fluorescent, security pigments and white pigments can be made in accordance with the present invention.

In the present invention, it is preferable that inorganic fine particles be externally added to the toner particles. The inorganic fine particles to be externally added to the toner surface, i.e. the inorganic surface additives, can be any suitable inorganic fine particles for use in printing systems, e.g. one or more kinds selected from the group consisting of a titanium oxide fine particles, alumina fine particles, strontia fine particles, zirconia fine particles, magnetite fine particles and silica fine particles. By inorganic particle, it is meant particles comprising an inorganic element such as aluminium, strontium, titanium, zirconium or silicium but it does not exclude such particles comprising additionally an organic part present as an internal component or as a surface treatment for instance. A main peak particle diameter of the inorganic fine particles in a particle size distribution based on the number is preferably in the range of 8 to 200 nm.

It is more preferable that the surface of each of the inorganic fine particles to be used in the present invention is subjected to a hydrophobizing treatment. In addition, the inorganic fine particles may be subjected to an oil treatment.

Depending upon the type of surface additives and specific density, the amount of such additives that is used in toner according to the present invention can be higher or lower than 3 parts by mass. The total content of the inorganic fine particles to be used in the present invention is preferably at least 0.5 parts by mass, preferably at least 1.0 parts by mass, preferably at most 3.0 parts by mass, preferably less than 2.0 part by mass, more preferably less than 1.9 part by mass, most preferably less than 1.8 part by mass. For instance, the total content of the inorganic fine particles to be used in the present invention can be from 0.5 to max 3.0 parts by mass, more preferably 1.0 to 2.0 parts by mass with respect to 100 parts by mass of the toner particles. In all cases the amount of additives that doesn't release from the surface when applying the ultrasonic energy should be at least 80% calculated to the total amount of additives. Preferably, at least 80% of each type of surface additive present stays on the surface of the toner particles when applying the ultrasonic energy.

Furthermore, in the present invention, other particles may be externally added to the toner particles before, together with or after the inorganic fine particles, e.g. for the purpose of improving flowability. Examples of the fine particles to be used include: Stearic acid and metal salts thereof, fluororesin powder such as vinylidene fluoride fine powder and tetrafluoroethylene fine powder; titanium oxide fine powder, alumina fine powder; finely powdered silica such as wet manufacturing silica, and dry manufacturing silica; and treated silica fine powder obtained by treating the surface of any of the above with a silane compound, an organosilicon compound, a titanium coupling agent, or silicone oil.

The toner of the present invention can be preferably produced according to a general method for producing toner including: a step of sufficiently mixing a binder resin, an optional filler, colorant, an optional releasing agent, and another optional component such as an organometallic compound in a mixer such as but not limited to a Henschel Mixer or a ball mill; a step of melting, kneading, and milling the mixture by using a heat kneading machine such as a kneader or an extruder; a step of finely pulverizing the melted kneaded product after cooling the melted kneaded product to obtain finely pulverized products; adding additives and perform a step of surface or shape modification and optionally add additives for a second time.

The latter step is preferably done through dispersing the toner particles into an air stream and jetting this airstream into a hot air zone, followed by cooling down the toner air mixture and removal of the excess of air with a cyclone.

In case the surface or shape modification is done by using both mechanical and thermal energy (e.g. a Henschel type of mixer with heated surface) the temperature of the surface of the mixer is preferably accurately monitored. By adjusting the temperature to Tg+/−2 degrees and further optimizing, the speed of the rotating members and the duration of the process, different degrees of roundness and additive adhesion can be obtained. The degree of roundness can also be adjusted by the type and concentration of additives mounted before or during the process.

In the production of the toner of the present invention, each of the step of mixing, kneading, and pulverizing described above is not a particular limiting step of the invention, and can be performed under normal conditions with a known apparatus.

In order to obtain toner systems whereby the surface additives stay on the surface to more than 80% when tested as described above, one embodiment of the present invention includes mounting the additives followed by a thermal such as e.g. a thermomechanical treatment. Preferably, no more inorganic surface additive are added after the thermal treatment. For instance, it includes additive mixing in a Henschel type mixer (FM10) prior to or together with the shape modification or surface modification. All additive mixing conditions in this FM10 equipment were always the same with respect to speed range of the mixing apparatus (2200-2600 rpm or 22-26 meter per second). Preferably, the additive mixing process last long enough and is performed with an intensity level high enough to obtain toner systems whereby the surface additives stay on the surface to more than 80% when tested as described above. The intensity level is a function of the blending speed. Preferably, the mixing lasts at least 3 minutes. Preferably, the mixing does not last more than 9 minutes. The surface modification in these examples has been done with a hot air treatment device (manufactured by Nippon Pneumatic Mfg. Co) with a throughput of 45-60 kg/hour, with a hot air zone of 50 cm, a temperature in this zone between 160-215° C. and a residence time of the toner of 10 to 50 milliseconds. Therefore we apply a mean air velocity of 18-22 meter per second. The increase in size which can occur due to coagulation of the toner particles is kept below 4% looking at the size fraction of 10.89 micrometer, when we start with a toner with an average particle size of 8 micron.

In accordance with an embodiment of the present invention, the toner of any of the embodiments of the present invention is mixed with a magnetic carrier to be used as a two-component developer for further improving image quality and for obtaining a stable and good image for a long time period also in the screened images.

Examples of an available magnetic carrier include generally known magnetic carriers such as: iron powder with an oxidized surface or unoxidized iron powder; metal particles such as iron, lithium, calcium, magnesium, nickel, copper, zinc, cobalt, manganese, chromium, and rare-earth elements, and alloy particles or oxide particles thereof; magnetic materials such as ferrite; and magnetic material-dispersed resin carriers (so-called resin carriers) each comprising a magnetic material and a binding resin that holds the magnetic material in a dispersed state.

It is preferable to use resin carriers each having a small specific gravity for a toner which has a small particle diameter. It is preferable to use a resin-coated carrier comprising: a magnetic core particle comprising a magnetic material; and a coating layer formed from a resin on the surface of the magnetic core particle.

A number average particle diameter of the magnetic carrier to be used in the present invention is preferably in the range of 15 to 80 μm, more preferably in the range of 25 to 60 μm.

Experimental Part

Preferred measurement methods for physical properties related to the present invention are described below.

Additive Loss

We used the method as described in U.S. Pat. No. 6,878,499 which we adapted on certain points in order to make it compatible with our analytic and technical means.

Step 1: Dispersing:

Take a goblet glass of 100 mL, check if it is pure and weigh 2.6 g (±0.1 g) of the toner. Add 40 mL (±1 ml) surfactant. Stir the mixture for 5 minutes using a magnetic stirring apparatus. Remove the magnet.

Step 2: Ultrasonic Treatment

The ultrasonic bath Elma Transsonic T 700 equipment has to be filled with 5960 mL of water. The water is pretreated for 30 minutes in order to remove all air which is included. The sample glass with the toner/water mixture is always place at the same position in the bath and establish the ultrasonic treatment for a duration of 5640 seconds at full power. The temperature before and after is checked and the difference should not be higher than 15° C. During this action the total amount of energy transferred to the toner particles should be in the range of 4500-4700 J/gram.

Take the sample from the ultrasonic bath and empty it into a centrifuge tube.

Step 3: Centrifuge

The sample is subsequently centrifuged for 3 minutes at 2000 rpm. Remove the upper liquid layer and add 40 mL of deionized water, shake the mixture and recentrifuge at the same conditions. This is repeated another time.

Step 4: Filtration:

After centrifuging a third time and the water layer poured off, the mixture is transferred to a filtration paper and the mixture is filtered under reduced pressure and rinsed several times with deionized water. The residue on the filter is dried for at least 12 hours in an isolated environment at room temperature with water extracting material present in the same location.

Step 5: Incineration:

The toner is transferred from the filtration paper to a porcelain cup. The weight of the cup is taken before and after transfer so it is exactly known how much toner has been transferred into it. In the same time the reference toner (before treatment) is also weighed into a second porcelain cup.

Both toners are subsequently heated up to 600° C. and kept there for 4 hours. After cooling down to room temperature, the weight of both samples is measured. The difference in weight % of both samples is a measure for the loss of additives during the ultrasonic treatment. The XRF-analysis of both ash samples indicates per type of additive (Si, Ti, Al, Zr, . . . ) what has been lost during the ultrasonic treatment and gives the possibility to calculate for each element the loss of additives percentage wise.

Measurement of Average Circularity

The circularity is a parameter which indicates the roundness of a particle. When the circularity is 1 the particle is a perfect sphere.

The circularity of the toner is a value obtained by optically detecting toner particles, and is the circumference of a circle with the same projected area as that of the actual toner particle divided by the circumference of the actual toner particle. Specifically, the average circularity of the toner is measured using a flow particle image analyser of the type FPIA-2000 or FPIA-3000 manufactured by Sysmex corp. In this device, a sample is taken from a diluted suspension of particles. This suspension is passed through a measurement cell, where the sheath flow ensures that all particles of the sample lie in the same focusing plane. The images of the particles are captured using stroboscopic illumination and a CCD camera. The photographed particle image is subjected to a two dimensional image processing, and an equivalent circle diameter and circularity are calculated from the projected area and peripheral length.

Image Quality aspects 1–Edge effects+maintaining print density under all page coverage conditions.

When a magnetic brush delivers toner to the photoconductor drum, the toner responds to the electric fields present on the surface. When a the brush enters into an attraction field coming from a toner repelling field or the other way around, some memory effects can be visualized in the printed image. This means that a transition between a printed area to a non-printed are or from a full density printed area to a less dense printed area can result in less crisp transitions. These less crisp or high gradations transition points in a printed image are called white or black shadows.

The second aspect is the image density under all page coverages. A page coverage reflects to the part of the page which is covered by one toner type. This means that after printing 10KA4 1% coverage or 10% or 75% we have to be able to obtain the necessary colour density for all colours on paper. The printed samples were evaluated and both phenomena received a ranking from 0-5 (0 is bad, 5 is OK).

Image Quality aspects 2–Hollow characters and uniform transfer in single and multi layers.

For an explanation of the Hollow Character effect, reference can be made to the proceedings of the 22nd International Conference on Digital Printing Technologies, page 180-183, (2006) incorporated herein by reference. The level of hollow characters was observed visually. A red and green patch of 2 mm wide and 50 mm length was printing along the process direction. The red was printed as 100% yellow covered by 100% magenta and the green as 100% yellow covered by 100% cyan. The equality of the density of single and multi layer printing was also evaluated visually taking into account the complete width of the printed image when printed on a substrate thickness of at least 200 grams per square meter. The equality of the complete layer should be OK.

When evaluated OK means that for both the described image quality criteria, no defect at all occurred during printing at different speeds, Not OK means that some part of the dual colour layers is not completely filled for the hollow character issue or that the equality of the layers on thick substrates was not uniform over the complete width of the printed image.

Screen Disruption

With this aspect of the printed image we looked specifically at the uniformity of the screened images during long time printing. When the uniformity of the screens was evaluated as changed from the starting situation, then the evaluation was not OK. This effect should not establish itself when we ran at 90 mm/s for more than 60.000 A4 pages and when we ran at 600 mm/s for more than 200.000 A4 pages in order to receive the status OK. The Vr/Vf ratio for all duration experiments was 1.6 for both rollers in the dual roll and was 1.8 for the mono roll.

EXPERIMENTAL RESULTS

1) Comparative Examples

Toners 1, 2, 5 and 6 the additives were prepared in a two phase process. The first additive was mounted prior to the surface treatment, the second additive was added after the surface treatment. The difference between toner 5 and 6 is the mounting condition. The additives in toner 6 has been mounted 3 times longer compared to toner 5 (after the hot air treatment).

For toner 4 the two types of additives were mounted after the toner preparation and no surface treatment took place. This is what is called a regular crushed toner (with a low average circularity value)

In the case of toner 8, all additives were mounted before the surface modification or shape modification but the total amount of surface additive was 2%

1) Examples According to the Present Invention

In case of toners 3 and 7, all additives were mounted before the surface modification or shape modification and the total amount of surface additive was inferior to 2%.

| Toner | $SiO_2$ Added % | $TiO_2$ Added % | Average circularity | % $SiO_2$ Fixed | % $TiO_2$ Fixed | Total additives fixed >80% | Image Quality 1 Edge/ Density | Image Quality 2 | Screen disruption |
|---|---|---|---|---|---|---|---|---|---|
| Xeikon print test engine with one roll development unit at speeds from 90 to 200 mm/s | | | | | | | | | |
| 1 | 5 | 0.5 | 0.970 | 40 | >80 | NO | 4/5 | OK | OK |
| 2 | 0.75 | 0.5 | 0.970 | 70 | >80 | NO | 4/4 | OK | OK |
| 3 | 0.75 | 0.5 | 0.970 | >80 | >80 | YES | 4/3 | OK | OK |
| 4 | 1 | 0.2 | 0.940 | 15 | 40 | NO | 3/5 | NOT OK | OK |
| 5 | 0.6 | 0.15 | 0.975 | 50 | >80 | NO | 4/5 | OK | OK |
| 6 | 0.6 | 0.15 | 0.975 | 75 | >80 | NO | 4/4 | OK | OK |
| 7 | 1 | 0.5 | 0.970 | >80 | >80 | YES | 4/3 | OK | OK |
| 8 | 1.5 | 0.5 | 0.970 | 75 | >80 | NO | 4/4 | OK | OK |
| Xeikon print test engine with a dual roll development unit at speeds from 90 to 600 mm/s | | | | | | | | | |
| 1 | 5 | 0.5 | 0.970 | 40 | >80 | NO | 5/5 | OK | NOT OK |
| 2 | 0.75 | 0.5 | 0.970 | 70 | >80 | NO | 5/5 | OK | NOT OK |
| 3 | 0.75 | 0.5 | 0.970 | >80 | >80 | YES | 5/5 | OK | OK |

-continued

| Toner | $SiO_2$ Added % | $TiO_2$ Added % | Average circularity | % $SiO_2$ Fixed | % $TiO_2$ Fixed | Total additives fixed >80% | Image Quality 1 Edge/ Density | Image Quality 2 | Screen disruption |
|---|---|---|---|---|---|---|---|---|---|
| 4 | 1 | 0.2 | 0.940 | 15 | 40 | NO | 4/5 | NOT OK | OK |
| 5 | 0.6 | 0.15 | 0.975 | 50 | >80 | NO | 5/5 | OK | NOT OK |
| 6 | 0.6 | 0.15 | 0.975 | 75 | >80 | NO | 5/5 | OK | NOT OK |
| 7 | 1 | 0.5 | 0.970 | >80 | >80 | YES | 5/5 | OK | OK |
| 8 | 1.5 | 0.5 | 0.970 | 75 | >80 | NO | 5/5 | OK | NOT OK |

These results show the advantage of the dual roll developer unit concept with respect to the Image Quality 1 aspects and the fact that the screen disruption does not occur in the actual used mono roll development unit. From these results it is also clear that only the toners that fulfill fulfil both conditions (average circularity >0.95 and the additives stay onto the toner for more than 80% when ultrasonic energy in an amount of 4500-4700 5700 J/gram toner is applied is OK), are completely OK for all quality aspects during printing.

In case of the dual roll we have also been testing with other Vr/Vf ratio for both rollers.

Variations from 1.2 till 1.8 and did not result in any working window value whereby the disturbed screen pattern not occurred if we used shape modified toner where the additive loss for all additive types was >20% and average circularity was more than 0.95.

It is also clear that mounting the additives prior to shape modification doesn't always gives the desired result if the above mentioned criteria are not all fulfilled (e.g. sample 8). These data indicate that both criteria (shape factor>0.95 and total additive adhesion>80%) are to be fulfilled in order to obtain the desired image quality in this dual roll environment for high quality high speed printing. By looking at these results it is also clear why the >80% has not shown up before. Most toners are used in mono roll environment systems. We have observed that maintaining the image density with these type of toners is not so easy compared to the dual roll environment. The latter was also already observed in U.S. Pat. No. 6,598,466, where the relationship was shown between obtaining image density in print versus the amount of additive adhesion onto the toner surface.

It is to be understood that although preferred embodiments, specific constructions and configurations, as well as materials, have been discussed herein for devices according to the present invention, various changes or modifications in form and detail may be made without departing from the scope and spirit of this invention.

What is claimed is:

1. A process for printing or marking a substrate comprising the steps of:

providing a toner by mixing at least a binder resin and a colorant to form a mixture;

melting, kneading, and milling said mixture to obtain a melted kneaded product; and pulverizing said melted kneaded product;

said toner comprising toner particles having at least one type of surface additive, the toner particles having an FPIA average circularity of at least 0.95 and up to 0,985, wherein the total content of surface additives comprised in or on said toner particles is between 0.5% and 2% per weight of said toner particles, and wherein at least 80% wt of the total amount of surface additives remains on the surface of the toner particles when an ultrasonic treatment of 4500 to 4700 J/gram of toner particles is applied; and using said toner in a dual roll dual component development system with at least two oppositely rotating magnetic rollers to print or mark a substrate, wherein said toner is mixed with magnetic carrier particles thereby providing a two component developer, said magnetic carrier particles have a size from 15 to 60 microns; and wherein said toner particles are developable at a speed of at least 90 mm/s and up to 1000 mm/s.

2. The process according to claim 1, wherein said toner particles have a toner particle size distribution having a volume average particle size diameter from 5 to 10 μm.

3. The process according to claim 1, wherein said toner particles are obtainable by adding said surface additives to the toner before or while bringing the FPIA average circularity of said toner particles to 0.95 by modifying the shape or surface of said particles.

4. The process according to claim 3, wherein the shape or surface modification is performed by thermo mechanical means.

5. The process according to claim 3 wherein the shape or surface modification comprises a thermal air treatment.

6. The process according to claim 1, wherein said carrier particles have a size from 30 to 60 micron.

7. The process according to claim 1, wherein at least 80% wt of each type of surface additives stays onto the surface of the toner particles when an ultrasonic treatment of 4500 to 4700 J/gram of toner particles is applied.

8. The process according to claim 1, wherein said toner particles have a development speed of at least 90 mm/s and up to 600 mm/s.

9. The process according to claim 1, wherein said carrier is a resin-coated carrier comprising: a magnetic core particle comprising a magnetic material; and a coating layer formed from a resin on the surface of the magnetic core particle.

10. The process according to claim 1, wherein the relative linear speed of one of said rotating magnetic rollers (Vr) to a latent image member (Vf) is defined by the ratio (Vr/Vf) and is in the range of 1.2 to 1.8.

* * * * *